United States Patent [19]

Lopata

[11] 4,335,955

[45] Jun. 22, 1982

[54] ELECTROSTATIC DISPLAY APPARATUS

[75] Inventor: Ira Lopata, New York, N.Y.

[73] Assignee: Ragen Precision Industries, Inc., North Arlington, N.J.

[21] Appl. No.: 7,699

[22] Filed: Jan. 30, 1979

Related U.S. Application Data

[63] Continuation-in-part of Ser. No. 899,561, Apr. 24, 1978.

[51] Int. Cl.[3] ..... G03G 15/00

[52] U.S. Cl. ..... 355/16; 355/15

[58] Field of Search ..... 355/3 R, 16, 5, 12, 355/13, 15, 3 DD, 20; 96/1 R; 427/22

[56] References Cited

U.S. PATENT DOCUMENTS

| | | | |
|---|---|---|---|
| 3,128,683 | 4/1964 | Rubin | 355/16 X |
| 3,155,022 | 11/1964 | Schwertz | 355/16 X |
| 3,600,210 | 8/1971 | Haycock | 355/3 R |
| 3,647,293 | 3/1972 | Queener | 355/15 |
| 3,819,262 | 6/1974 | Estandarte | 355/15 |
| 3,914,045 | 10/1975 | Namiki et al. | 355/3 DD |
| 3,936,178 | 2/1976 | Kuehnle | 355/5 |
| 3,973,846 | 8/1976 | Sullivan et al. | 355/3 R X |
| 4,136,943 | 1/1979 | Koizumi | 355/16 X |

*Primary Examiner*—Richard L. Moses
*Attorney, Agent, or Firm*—Daniel H. Bobis

[57] ABSTRACT

An electrostatic display, recall or print apparatus in which a magnetically toned latent electrostatic pattern or image on an electrostatic strip is inspected, and either advanced to a fusing station for being made permanent, or withdrawn to a detoning station for magnetic detoning, from which the strip may once more be advanced and reused for the application of a different electrostatic image and for retoning.

1 Claim, 2 Drawing Figures

ELECTROSTATIC DISPLAY APPARATUS

CROSS-REFERENCE TO RELATED APPLICATION

This application is a continuation in part of the Electrostatic Display Apparatus referred to in copending Application Ser. No. 899,561 filed Apr. 24, 1978 by the present applicant, which application relates to the cascade toning of electrostatic images, which are either fused or subsequently detoned by a neutralizing means and a vacuum pick up of the toner, rather than as in the present application wherein the toning means performs the dual function of toning and detoning.

BACKGROUND OF THE INVENTION

1. Field of Invention

This invention relates generally to electrostatic display apparatus and particularly to such apparatus in which an electrostatic image passes a magnetic toner, is magnetically toned, and may be inspected at an inspection station; at the option of the operator, the toned electrostatic image is passed to a fusing station to become a permanent image, or withdrawn to the magnetic toning-detoning station, wherein the magnetic toner removes the toner; the blank strip may be reused by being reimaged and retoned.

2. Prior Art

The ordinary electrostatic display apparaus contemplates the production of copies which are permanent. Usually no provision is made for inspection of the copy before it is made permanent (fused) because the person operating the copier knows that he is copying a particular pre-selected display. However, in systems wherein innumerable bits of information are stored and called up for use, when a particular bit of information is retrieved and electrostatically reproduced, it is desirable to inspect the toned but unfused copy to determine whether it is a useful bit of information, before it is made permanent by fusing, for then it might be a useless bit of information. In some systems, there may be a central pool of available stored information that is subject to being recalled and copied at numerous terminals. A display of the stored information on the face of the cathode-ray tube may not be part of the system. The information may be transferred to a strip as a latent electrostatic image, toned, and fused. If the xerographic print is not a useful one, the strip is discarded and this practice may become wasteful and costly. Thus it becomes desirable to preview the unfused image to determine whether it is useful and should be made permanent, or should be discarded. Such an apparatus is shown in U.S. Pat. No. 3,973,846 issued Aug. 10, 1976 to Sullivan et al. where the image is previewed before it is returned past a magnetic toner for being fused.

SUMMARY OF THE INVENTION

It has been found that electrostatic images on a strip rendered visible by toning can be rendered permanent at the election of the person operating the apparatus, by inspecting the toned electrostatic image at a viewing station, and then at the option of the operator, passing the strip directly either to a fusing station to make it permanent, or withdrawing the strip from the viewing station once more past the magnetic toning device that has previously toned the image; on second passing, the magnetic toning device magnetically detones the image. The exposure of a toned, unfused electrostatic image at a viewing station to ambient light of the magnitude of eight foot candles for one second is sufficient to neutralize and discharge the electrostatic image. Inspection of a toned, unfused electrostatic image at an inspection station usually takes place in ambient light of fifty to one hundred foot candles, which is more than sufficient to neutralize the electrostatic image to which toner has been applied. Thereupon, to reverse the strip past the magnetic toner causes the discharge, delivery and migration of the toning particles back to the magnetic toner, leaving the strip relatively completely free of any toner. The strip then is ready for reuse and may be electrostatically recharged, retoned and delivered to the display station. In the event that the fibers of the paper retain by attachment, any of the toner which is not magnetically withdrawn by the toner, then a back up neutralizer may be used to neutralize any residual electrostatic charge, and either a magnetic pick up or a vacuum device may be added to remove any residual toner not picked up by the device that applied the toner originally. Magnetic toners are well known for rendering visible (toning) a latent electrostatic image. They usually consist of a non-magnetic sleeve which is cylindrical in shape, stationary and covered by an overlay of Mylar (sheath) and an internal rotatable shaft carrying at least one longitudinal magnet to attract and spread the toner over the surface of the magnetic sleeve. The toner powder is usually minute magnetic particles covered with a colored resin which is pressure sensitive and will adhere to latent electrostatic images formed by charges on a sheet or strip. Such toning devices are available from Hitachi Metals Limited. This invention is particularly adapted for use with magnetic toning devices and is not effective with the cascade toners, or with the toners which utilize liquid toners, for the system is dependent upon the magnetic withdrawal of applied toner by a magnetic device. The recall of the toned electrostatic strip bearing the unfused image causes that image which has been previously neutralized by ambient light, to be detoned by the magnetic toner.

DRAWINGS

These objects and advantages as well as other objects and advantages may be achieved by the device shown by way of illustration in the drawings in which.

PREFERRED EMBODIMENT

Figure 1:
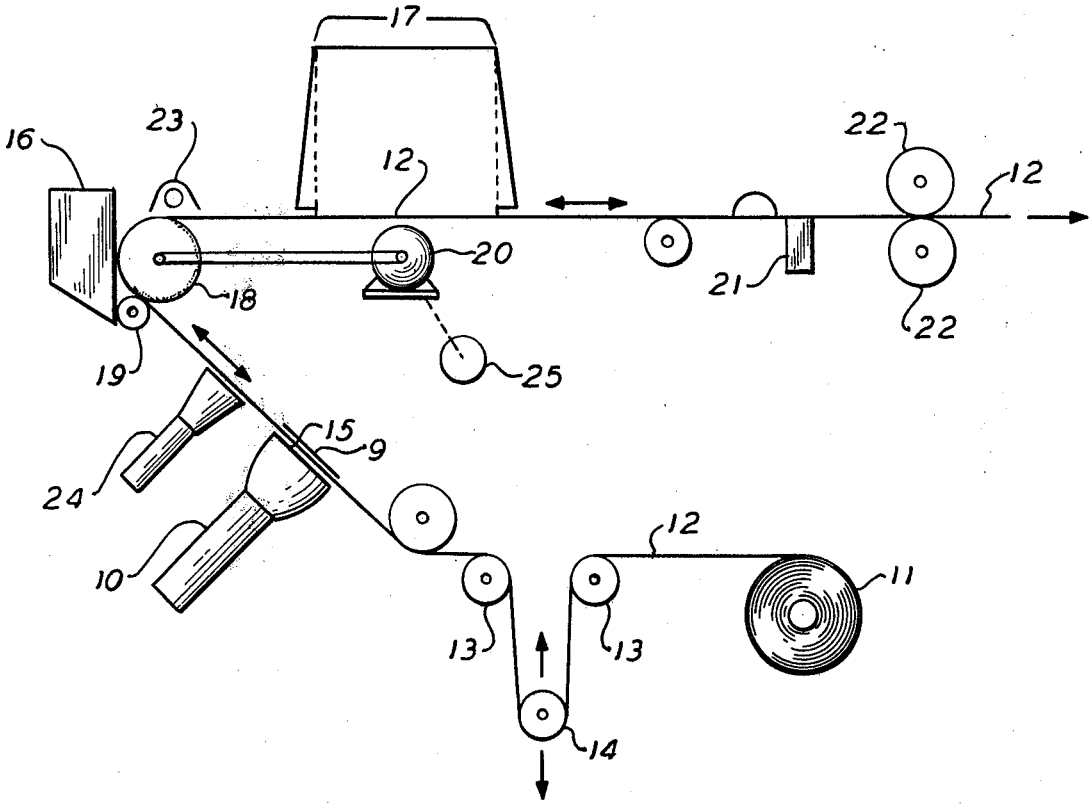
FIG. 1 shows a schematic view of the apparatus for magnetically toning an electrostatic image, for viewing an unfused, toned electrostatic image, which electrostatic image becomes neutralized by ambient light at a viewing station and may be either withdrawn to be erased by a magnetic toner-detoner, or advanced to be fused.

Referring now to the drawings in detail, there is provided a supply roll 11 containing a dielectric strip 12. The dielectric strip 12 is made of electrostatic paper and is well known for use in copying machines. The paper is receptive to electrostatic charges to form a latent electrostatic image. Such electrostatic charges are normally neutralized, if they are exposed to light. Electrostatic strips may have coatings of vinylchloride-vinylacetate copolymer; many other ionic materials are well known. It is understood that any electrostatic strip may be used in the present invention and is not to be limited to those which have been specifically referred to. The strip 12 originates from a roll and can be led over a pair of idlers 13. A roller 14 constitutes a mean to take up slack in the strip 12 when the direction of feed of the strip is reversed.

The electrostatic strip 12 is charged by being exposed to a high resolution cathode-ray tube 10. Another method of imaging is to precharge the strip 12 by a corona charging device and then bleed off selected portions of the charged area to leave only the image desired. There are various types of tubes used for charging the electrostatic strip, and this invention is not limited to any particular type of charging tube. For example, the tube 10 may be of the kind which has closely spaced fine metal wires 15 on its face. Any charge on the face plate selectively charges the metal wires 15 and imparts a corresponding electrostatic charge pattern on the strip 12. The fine wires in this type of charging tube are embedded in the face of the tube and are insulated from each other. An electron beam in the c.r. tube sweeps across the ends of the wires 15 on the face of the tube, electrons on the wire are deposited onto the surface of the electrostatic strip 12. The strip 12 is disposed in close relation to the wires 15 and is supported by an electrode 9 at a predetermined potential such as to attract the electrostatic charge from the wires 15. The strip 12 next moves past a toner-detoner 16 which in the case of the present invention is a magnetic type toner as previously referred to, because this toner box, in addition to toning firstly the latent electrostatic image when the strip 12 is first passed by it, also performs a detoning function if the electrostatic strip 12 is secondly, returned past it. This detoning function is performed by the magnetic toner. In the present device, the toned electrostatic image is neutralized by being exposed to ambient light at an inspection station 17. If the toned electrostatic strip 12 is rejected and is withdrawn from the inspection station 17, it passes the magnetic toner for the second time; the toner on the strip 12 is no longer bound by the electrostatic charge; it is magnetically attracted and withdrawn from off of the strip 12, into the toner 16.

Figure 2:
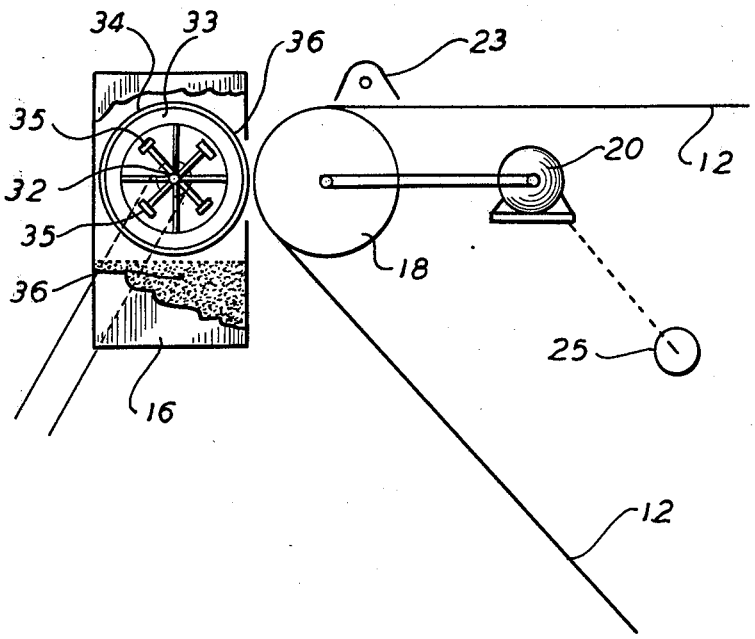
FIG. 2 is a vertical partially sectional view of the magnetic toner.

In the operation of this device, after the initial pass of the strip 12 past the toner 16, the strip 12 moves to and pauses for inspection at a viewing station 17 which viewing station is between the toning station and a fusing station (fuser 22). A feed roller 18 drives the strip 12. The feed roller 18 is driven by a reversible motor 20. The magnetic toner 16 operates at all times when the feed motor 20 operates. This accomplishes the delivery of the toner to electrostatic charges on the strip during the forward feeding operation, and further accomplishes the magnetic removal of toner from the electrostatic strip 12 when the motor 20 is reversed to withdraw the strip past the toner 16. The toner 16 is of the Hitachi type previously mentined but other types of magnetic toners may be used. The toner powder 36 is attracted to and adheres to the latent electrostatic image on the strip 12, making it visible. FIG. 2 shows generally the type of magnetic toner now in wide general use. The magnetic toner 16 is a housing in which there is a fixed, non-magnetic sleeve 33. The surface of the sleeve 33 is covered by a fixed plastic sheath 34 (as for example Mylar). The sheath 34 is close to the passing electrostatic strip 12 which is minutely spaced from it on the feed roller 18. Inside of the fixed sleeve 33, there are mounted a plurality of longitudinal magnets 35 which rotate on a drive shaft. These magnets attract toner 36 to the surface of the sheath 34. As the magnets 35 are revolved, they cause a migration of toner rather uniformly over the entire surface of the sheath 34. As the toner 36 on the surface of the sheath 34 is opposite to the electrostatic image on the strip 12, it leaves the sheath 34 and migrates to the strip, toning only the electrostatic image.

Immediately beyond the toner 16, there is a viewing station 17. There must be sufficient ambient light to enable the operator of the apparatus to view the image and to determine whether it is an embodiment of acceptable information. The strip 12 is fed by the engagement of the feed roller 18 with an idler 19 or in any other suitable manner. It is well known to provide conveyors instead of feed rollers to move the strip 12. The motor 20 is reversible and normally drives the feed roller 18 forward to deliver the strip 12 toward a fuser 22.

At the viewing station 17, if inspection of the strip 12 reveals that the toned electrostatic image displays information which is useful, the motor 20 is reactivated and delivers the strip to a knife 21 which cuts it off from the remainder of the strip. Following the cut off of the selected portion of the strip, the toner is fused and permanently affixed to the strip 12. This may be accomplished by fusing rollers 22 or by heat lamps which are well known in the art. With the fusing of the toner on the strip 12 and the cutting of the strip by the knife 21, the strip is ejected from the apparatus. As shown in FIG. 1, the electrostatic strip 12 proceeds from the viewing station 17 to the fusers 22, 22 on a planar horizontal course.

If the toned but unfused image viewed at the station 17 does not contain information which is useful, a reversing switch 25 reverses the motor 20 and the strip 12 is withdrawn from the viewing station 17. It is noted that ambient light at the viewing station has neutralized the electrostatic charge on the strip 12, while the strip 12 has been halted for inspection at the viewing station 17. Since a mere eight foot candle exposure per second approximately is sufficient to discharge the electrostatic charge on the strip 12, the toner is no longer strongly attracted to the electrostatic strip, which is then being withdrawn by the reversed motor 20 past the toner 16. The magnetic influence of the toner 16 attracts the toner from off of the electrostatic strip 12, leaving it blank and ready for subsequent re-imaging by the tube 10. In the event that the strip 12 has an exceedingly retentative fibrous nature, some of the toner powder may become intimately involved with the fibers or a residual electrostatic charge may still hold the toning powder, which then is withdrawn completely by the toner 16, for such a contingency, an auxiliary discharge unit 23 of conventional design, such as a lamp, is provided which effectively neutralizes any residual electrostatic charge on the strip 12. The strip moving past this discharge unit 23 is completely discharged and the strip continues to move past a vacuum pick up 24 which collects any residual toner from the strip. The discharge unit 23, and the vacuum pick up 24, are not normally required for complete detoning of the strip 12. They may be only operated when the strip 12 is reversed by the motor 20 and are merely an optional insurance that the strip is completely divested of any residual electrostatic charges and retained toner powder. The discharge unit 23 electrostatically neutralizes these residual charges that originally were imparted by the cathode-ray tube 10. The particular cathode-ray tube 10 referred to as an example for use in this apparatus is one which has metal fibers on its face and is well known and may be obtained from the Westinghouse Corporation, Litton Industries, Thomas Electronics of Wayne, N.J. or other suppliers.

This apparatus may be embodied in numerous terminals which may be activated to display the same image simultaneously. The image can be easily read as black print upon a white background, and before it is fused, becomes neutralized by ambient light and thus the strip can be withdrawn and the image erased by being detoned, or the strip may be moved forward, the image fused, the strip cut from the main portion thereof and discharged from the apparatus. In this manner, waste of portions of the strip is avoided and the rejected portion when detoned, can be re-imaged and retoned and used again. In addition, the electrostatic image appears in black on white and is easy to read, rather than being displayed as a green luminescent image on a black background, which may be difficult to read.

What is claimed is:

1. An apparatus for forming, toning, and displaying the unfused visible electrostatic image on an electrostatic strip, and alternatively and selectively for erasing the electrostatic strip or for fusing the visible electrostatic image to make a permanent copy thereof includes, a. source means for said electrostatic strip, b. a generally horizontal planar surface means having a viewing station thereon disposed in spaced relation to the source means, said planar surface means having an inlet end and an outlet end for the electrostatic strip.

c. means connected to the source means to normally feed the electrostatic strip in a forward direction through a predetermined course to and across the viewing station on said planar surface means to dispose the electrostatic strip for inspection at the viewing station and said feed means including, means for reversing the direction of movement of the electrostatic strip, d. means between the source means and the inlet side of the planar surface means and disposed relative the electrostatic strip to form a latent electrostatic image on the electrostatic strip, e. magnetic toning means between the latent electrostatic image forming means and the inlet side of the planar surface means to make the latent electrostatic image visible for inspection when the electrostatic strip is moved forward to the viewing station includes, i. a non-magnetic, stationary cylinder, ii. a plastic collar on the cylinder, iii. a revolvable shaft disposed in the cylinder, iv. at least one magnet mounted longitudinally on the shaft, v. a bin of magnetic particles adjacent to the cylinder within the influence of the magnet in the cylinder, and vi. the plastic collar closely spaced from the electrostatic strip as it is fed whereby the toner is attracted to the electrostatic image, f. means adjacent the outlet end of the planar surface selectively operable only on forward movement of the electrostatic strip to fuse the desired visible electrostatic image to form a permanent copy thereof, and g. a normally non-operative means disposed adjacent the inlet end of the planar surface means selectively operable when the reversing means is actuated to move the electrostatic strip in a reverse direction to neutralize and remove toner from the unfused visible electrostatic image to permit reuse of the electrostatic strip.

* * * * *